United States Patent [19]

Krause

[11] 4,041,732

[45] Aug. 16, 1977

[54] STRAIGHT AND CIRCULAR KNITTING MACHINE

[75] Inventor: Erich Krause, Bopfingen, Germany

[73] Assignee: Universal Maschinenfabrik Dr. Rudolf Schieber KG, Westhausen, Germany

[21] Appl. No.: 672,356

[22] Filed: Mar. 31, 1976

[30] Foreign Application Priority Data

Apr. 8, 1975 Germany ..... 2515201

[51] Int. Cl.[2] ..... D04B 7/00; D04B 15/66

[52] U.S. Cl. ..... 66/75.2

[58] Field of Search ..... 66/75 A, 154 A, 50 R

[56] References Cited

U.S. PATENT DOCUMENTS

| | | | |
|---|---|---|---|
| 3,715,897 | 2/1973 | Hadam | 66/75 A |
| 3,717,014 | 2/1973 | Kowler | 66/75 A |
| 3,913,354 | 10/1975 | Kowler et al. | 66/75 A |

*Primary Examiner*—Ronald Feldbaum

*Attorney, Agent, or Firm*—Sughrue, Rothwell, Mion, Zinn and Macpeak

[57] ABSTRACT

A straight knitting machine comprises needles in a needle bed and cam means for actuating the needles for casting on, loop forming and stitch transfer, during which operations the needles are selected by lowering or lifting the needles into or out of the needle bed so that a foot of each needle completely or partially projects from the needle bed, or is withdrawn completely into the needle bed and is thus selectively engaged by lifting portions of the cam means. The needles are raised by spring means and are pressed into the needle bed by pressure strips mounted on a slide. A selector element is associated with each slot in the needle bed for transmitting control movements from the pressure strips to the needles and a shaft of each needle is retained in an intermediate member. The intermediate members are provided with fixed feet arranged in rows for engagement by the pressure strips and with a further foot movable selectively into different rows for engagement by the pressure strips.

16 Claims, 26 Drawing Figures

STRAIGHT AND CIRCULAR KNITTING MACHINE

This invention relates to a straight knitting machine having needles actuated by a cam for the purpose of casting-on, loop-forming and stitch-transfer operations and in which the needles are selected by lowering or lifting the needles or an element which controls them into or out of the needle bed, so that a foot of each needle or of the elements controlling the needles completely or partially projects from the needle bed or is sunk completely into the needle bed and is thus selectively engaged by lifting portions of the cam, the needles or the elements controlling them being raised by a spring and being pressed into the needle bed by means of pressure strips which are mounted for staggered displacement on a slide which carries the cam, a selector element selectively adjustable in several stages with respect to each row of pressure strips being associated with each slot in the needle bed.

A number of different techniques and forms of apparatus have been used on straight knitting machines for the production of knitted pieces having different patterns. The widest pattern range is obtained when a Jacquard mechanism is built on to the straight knitting machine. Such Jacquard mechanism however represents a considerable capital outlay as regards both the manufacture and the setting of the straight knitting machine. Therefore, if a pattern having a low stitch ratio is to be produced on a straight knitter, the pattern is preferably selected by means of pattern plates. Selection of the pattern in this way suffers from the disadvantage that when the pattern is being set, the pattern plates and, in some cases, the needles, too, have to be tilted. This results in an uneconomically lengthy setting time.

Straight knitters are also known in which, as with a Jacquard mechanism, the pattern plates are selected through a drum-control means. Although this dispenses with the need to tilt pattern plates, the lateral stitch ration, which is continuously repeated, is limited and the range of patterns is thus restricted.

Finally machines have been developed especially for the glove industry in which tilting plates, which in turn are controlled by pressure strips mounted on the carriage, can be brought into various selected positions. It is possible with apparatus of this kind to set patterns as required over the entire width of the knitting machine. If this method of pattern selection is applied to straight knitting machines for the production of outer clothing, there remains the problem of forming different edges to the knitted pieces, which edges have to be provided by appropriate selection of the needles. The known machine suffers from the disadvantages that when the stitch pattern is changed from, for example 1:1 to 2:1, the needles must be tilted, and despite the fact that the pattern is set with the aid of tilting plates and pressure strips, displaceable lifting parts are necessary in the needle cam mechanism. Finally, this type of patterning suffers from the disadvantage that when the working width is altered, those needles that are not to participate in the knitting operations have to be withdrawn. For this purpose it is necessary to pull bars out of the needle bed.

. The object of the present invention is therefore to provide a straight knitting machine of the initially described kind which enables a large number of patterns to be obtained and which permits variation in the basic setting of the machine and in the work width without the need for moving lifting parts in the needle cam mechanism without it being necessary to reverse or withdraw needles or pattern plates.

According to the invention, this object is achieved by the provision of a straight knitting machine including needle means in a needle bed, cam means for actuating said needle means for carrying out casting-on, loop-forming and stitch transfer, during which operations the needle means are selected by lowering or lifting the needle means into or out of the needle bed so that a foot of each needle means completely or partially projects from the needle bed or is withdrawn completely into the needle bed and is thus selectively engaged by lifting portions of the cam means, said needle means being raised by spring means and being pressed into the needle bed by means of pressure strips which are mounted for staggered displacement on a slide which carries the cam, wherein a selector element selectively adjustable in several stages with respect to each row of said pressure strips is associated with each slot in the needle bed, and for the purpose of transmitting control movements from the pressure strips to each needle means, a shaft of the needle means is mounted in a respective intermediate member without clearance above and below, the intermediate member having feet arranged in a plurality of rows for engagement by one or more pressure strips associated with the rows of feet, none, one or more of said feet are immovably arranged on each intermediate member, and at least one movable foot is provided on each intermediate member for movement selectively into different rows, the position at which the intermediate members in a needle compartment of the knitting machine are inserted not being altered, and the cam having no displaceable lifting parts for moving the needle means.

With the straight knitting machine in accordance with the invention it is possible, without tilting needles or elements which control them, to make a needle selection for knitting the edges of knitted pieces having pattern ratios of 1:1, 2:1 etc. simply by effecting a selection on control apparatus of the machine.

A shaft of each needle or of an element controlling it preferably has a notch whereby the needle or the element controlling it is latched into the intermediate member when in the "non-operative" position.

In accordance with a further preferred feature of the invention, the pressure strips which press on to the feet of the intermediate member are mounted in a parallelogram guide arrangement in the slide, and the depth of displacement of the pressure strips is limited by displaceable stop strips. This solves the problem of mounting the pressure strips in as compact a manner as possible so as to achieve the greatest possible number of likely pattern positions. Hitherto, a compact mounting system of this kind has usually proved unsuccessfuly because of the difficulty of providing guides for the pressure strips.

The displaceable foot of the intermediate member is advantageously the foot of a selector plate for setting the pattern, which plate is displaceably mounted relative to the intermediate member. This arrangement avoids the need for providing additional bearing parts on the machine, particularly when the displaceable selector plate is mounted directly in the intermediate member and is immobilized in each of the positions in which it is set, by means of indentations formed in the intermediate member.

In order to offset swinging movements of the intermediate member during displacements, the displaceable selector plate may also be a tilting plate which is mounted in a separate plate bed extending over the entire width of the needle compartment and which is immobilized in each of its set positions in notches which are formed in a bar of the plate bed and extend over the entire width of the needle compartment.

To ensure that the movements of the pressure strips are efficiently transmitted to the needles or to the elements controlling them, the intermediate member is advantageously mounted in a parallel guide or by means of a parallelogram guide arrangement. Alternately the intermediate member can take the form of a lever mounted on a pivot.

In order to enable the pressure strips to be arranged in a particularly compact manner and to enable the parallelogram guide means for the pressure strips to be mounted farther apart from each other, it is advantageous for each pressure strip to be associated with a shift plate having a stop lug, in which a stop for retaining the shift plate in a selected position engages so as to control the shift plate. In this arrangement it is preferable for each shift plate to be associated with a stop strip on which is provided the stop for retaining the shift plate.

Some of the stops on the stop strip advantageously each incorporate a shoulder so that the associated shift plate can be retained by the stop at two different levels.

For the purpose of controlling the stop strips and therefore the shift plates, there is preferably associated with each stop strip a further stop which abuts against a stop pin controlled by an associated electromagnet. In order to bring the stops that retain the shift plates, and that incorporate a shoulder, into different positions, not just one, but several electromagnets with spaced stop pins are advantageously associated with these stop strips.

Finally, a particularly compact and advantageous form of the shift plates for the pressure strips of the different rows is obtained by arranging them parallel to and alongside each other and by arranging the associated stop strips in superimposed relationship in a plane at right angles to the planes of the shift plates.

Some preferred embodiments of the invention are illustrated by way of example in the accompanying drawings and will now be described in detail. In the drawings:

FIG. 1 is a cross-sectional side view of the needle bed of a straight knitting machine in accordance with the invention having an intermediate member mounted in parallel guides, and a pattern plate engaging in such manner that it can drive out the associated needle for casting-on;

FIG. 1*a* shows an integral needle and pattern plate;

Figure 5:
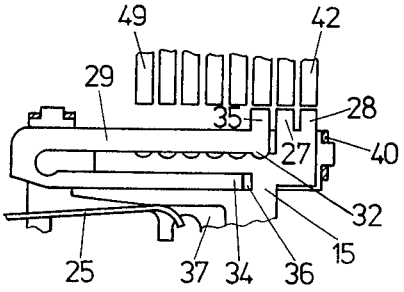
Figure 6:
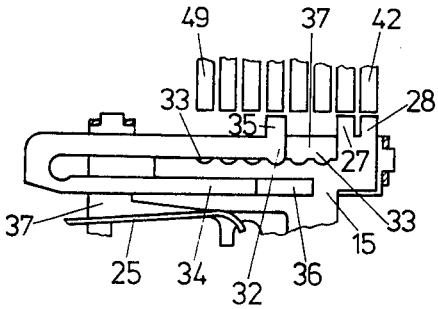
Figure 7:
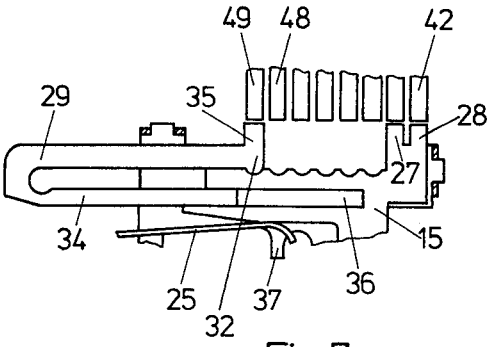
Figure 8:
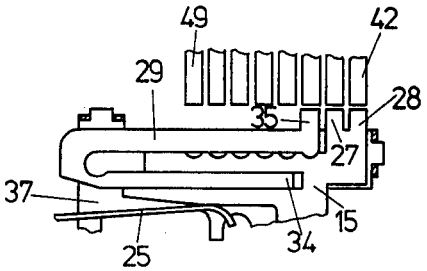
Figure 12:
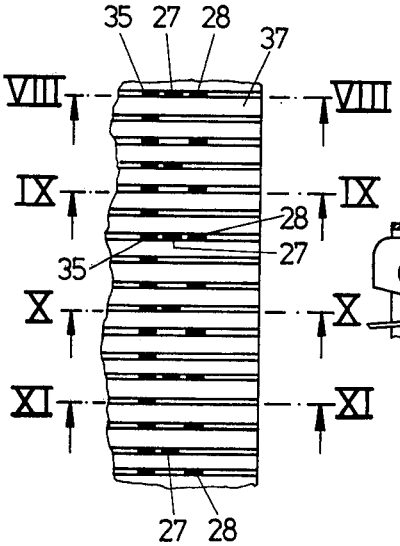
Figure 9:
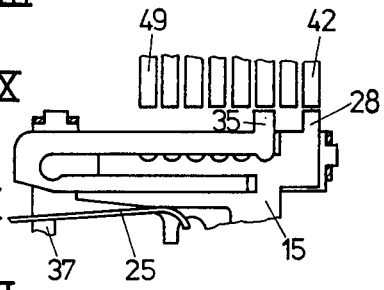
Figure 10:
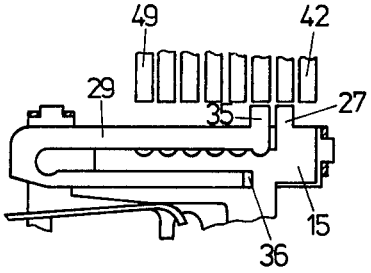
Figure 11:
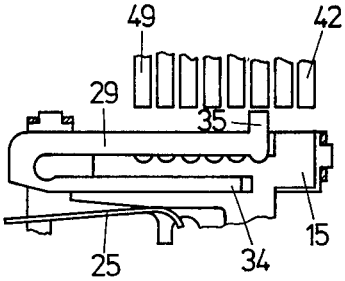
Figure 15:
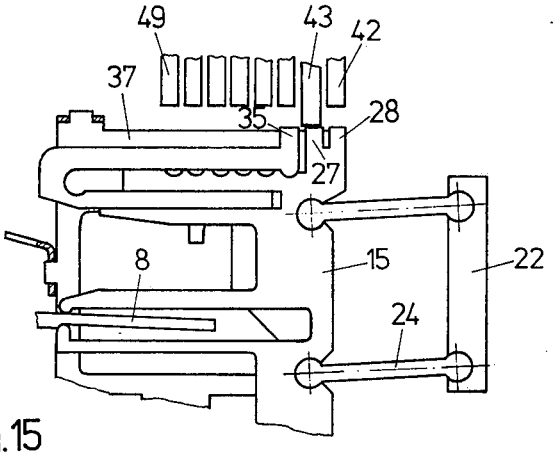
Figure 14:
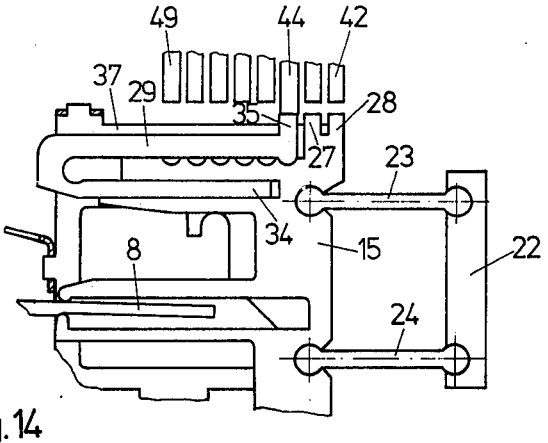
Figure 13:
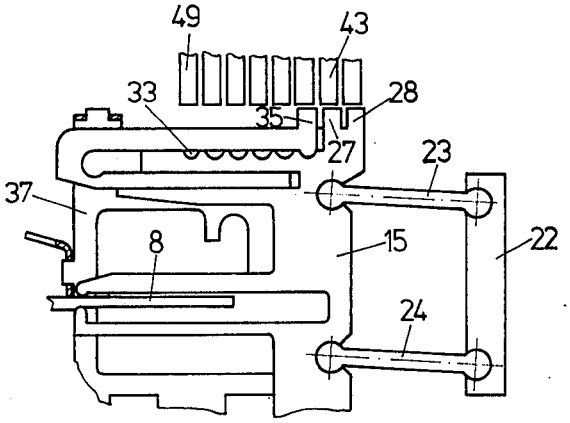
Figure 17:
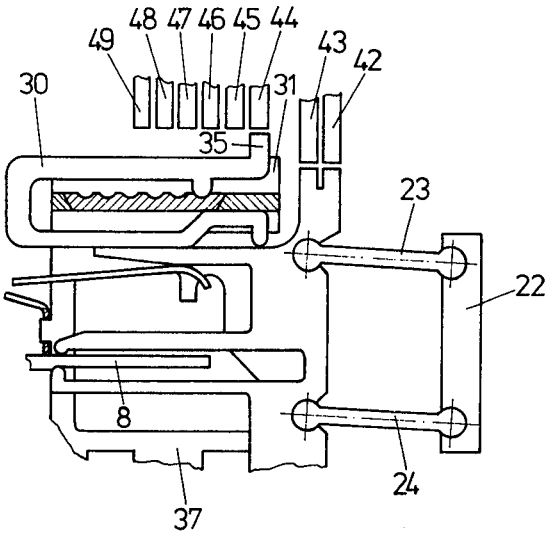
Figure 16:
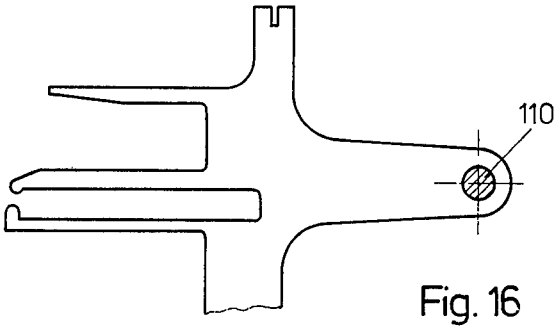
Figure 18:
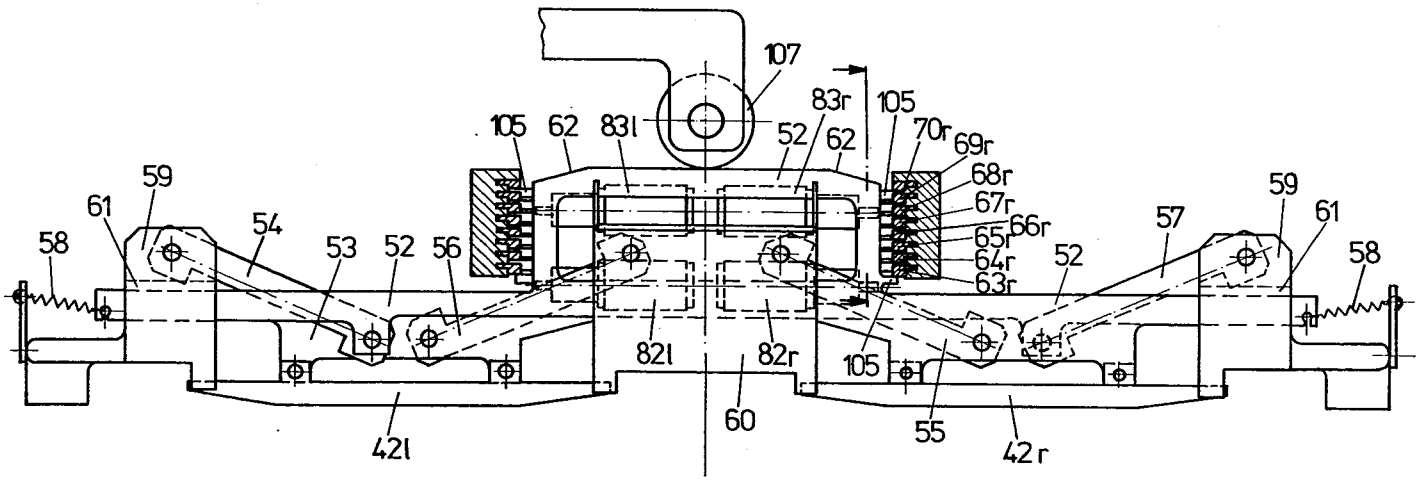
Figure 19:
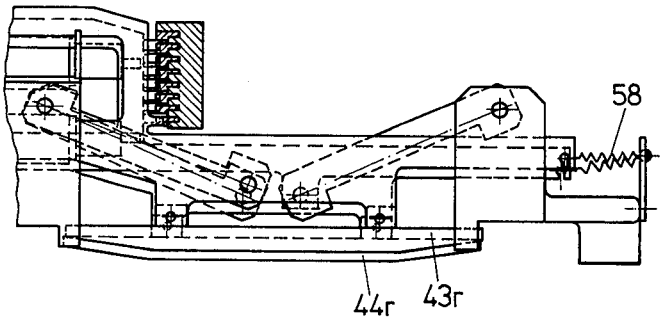
Figure 20:
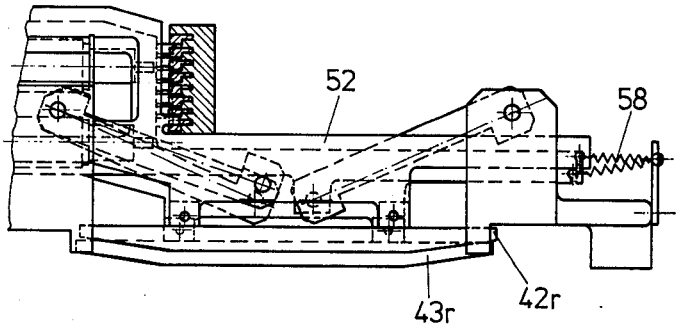
Figure 21:
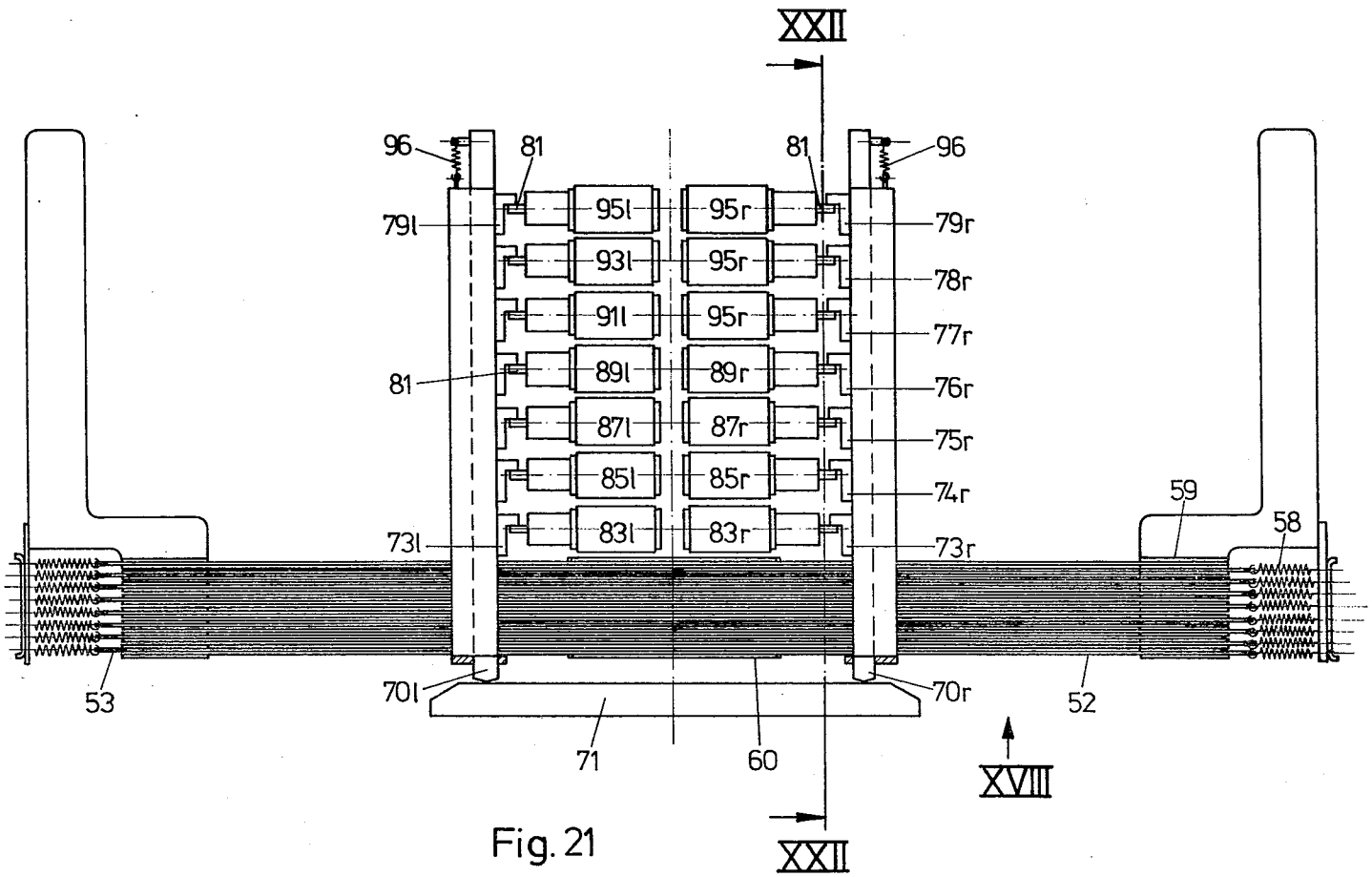
Figure 22:
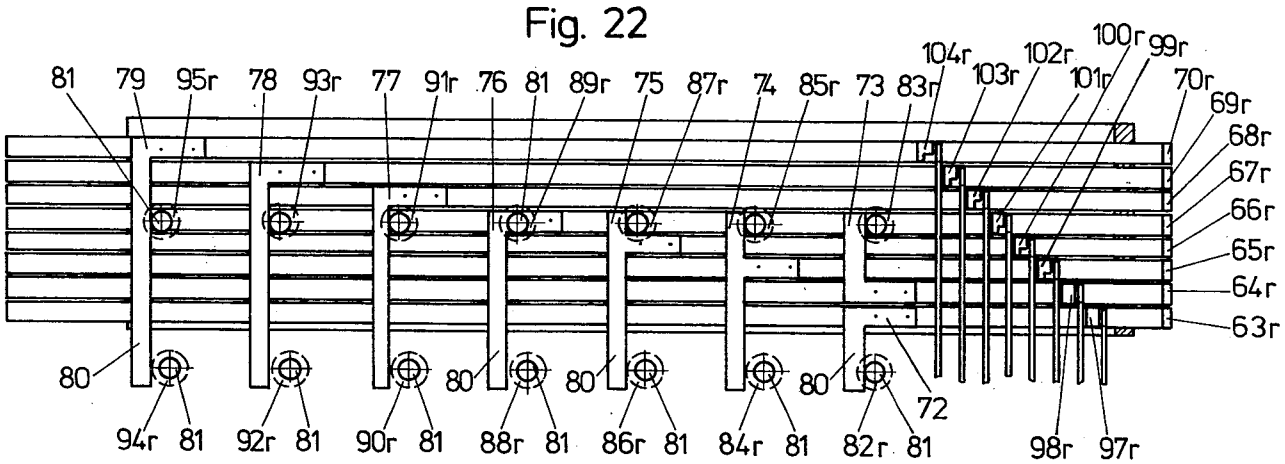
Figure 23:
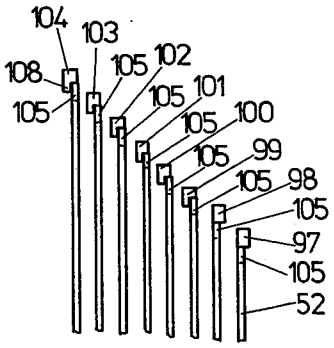
Figure 24:
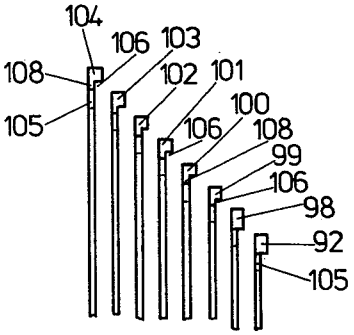

FIGS. 5 to 7 ar cross-sectional view of part of the intermediate plate with a selector plate mounted directly in the intermediate member and latched in various positions or rows;

FIG. 8 is a cross-section view of part of an intermediate member with two fixed feet, this section being on the line VII—VIII of FIG. 12;

FIGS. 9 and 10 are cross-sectional views of part of the intermediate diate member with only one fixed foot which is shown in different positions or rows in each of these Figures, these sections being drawn along the lines IX—IX and X—X of FIG. 12;

FIG. 11 is a cross-sectional view of part of an intermediate member without any fixed feet, the section being on the line XI —XI of FIG. 12;

FIG. 12 is a plan view of part of a needle bed in which intermediate members having different numbers of and differently arranged fixed feet are so positioned that in one row of feet a 1:1 knit and in a second row of feet a 2:1 knit can be set;

FIG. 13 is a cross-sectional view of part of an intermediate member with a parallelogram guide means in a "basic" position in which none of the pressure strips applies pressure;

FIG. 14 is a veiw similar to that of FIG. 13 and in which the intermediate member is pressed into a half-way position by the displaceable selector plate;

FIG. 15 is a view similar to that of FIG. 13 and in which the intermediate member is pressed into its bottom position by means of a fixed foot;

FIG. 16 is a cross-sectional view of part of an intermediate member which takes the form of a lever;

FIG. 17 is a cross-sectional view of an intermediate member in which the selector plate takes the form of a tilting plate which is mounted in a separate plate bed and presses on the intermediate member;

FIG. 18 is a cross-sectional side view of pressure strips and the means for mounting them on the slide;

FIG. 19 is a portion taken from FIG. 18 wherein one pressure strip is shown in the non-operative position and the other in the half-way position;

FIG. 20 is a portion taken from FIG. 18, wherein one pressure strip is shown in a non-operative position and the other in the fully operative position;

FIG. 21 is a plan view of the apparatus of FIG. 18 and shows control electromagnets and stop strips and the manner in which they are mounted on the slide;

FIG. 22 is a section through the apparatus of FIG. 18 on the line XXII—XXII of FIG. 21;

FIGS. 23 and 24 are detail portions from FIG. 22, and

Figure 25:
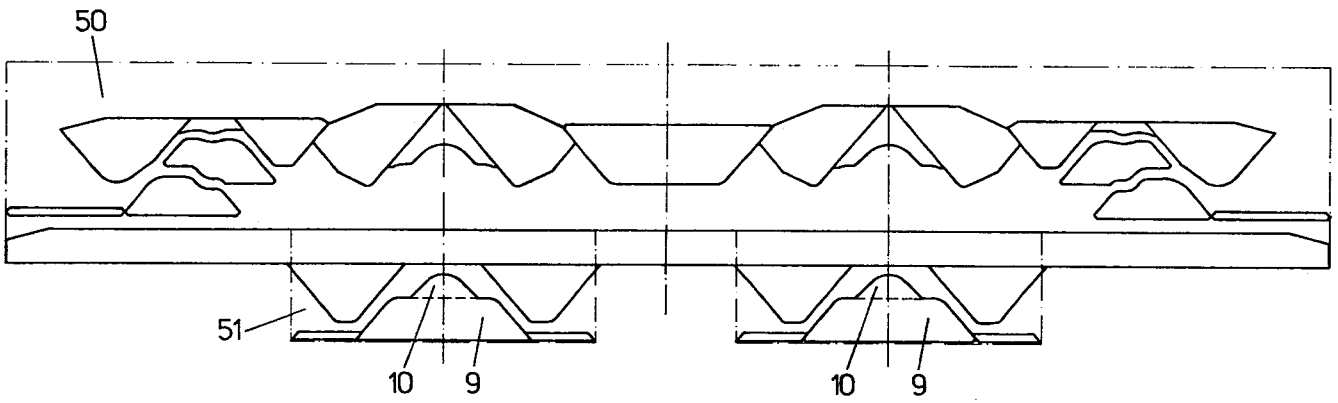

FIG. 25 is a plan view of a cam without displaceable lifting parts for moving the needles.

Figures 1, 1A:
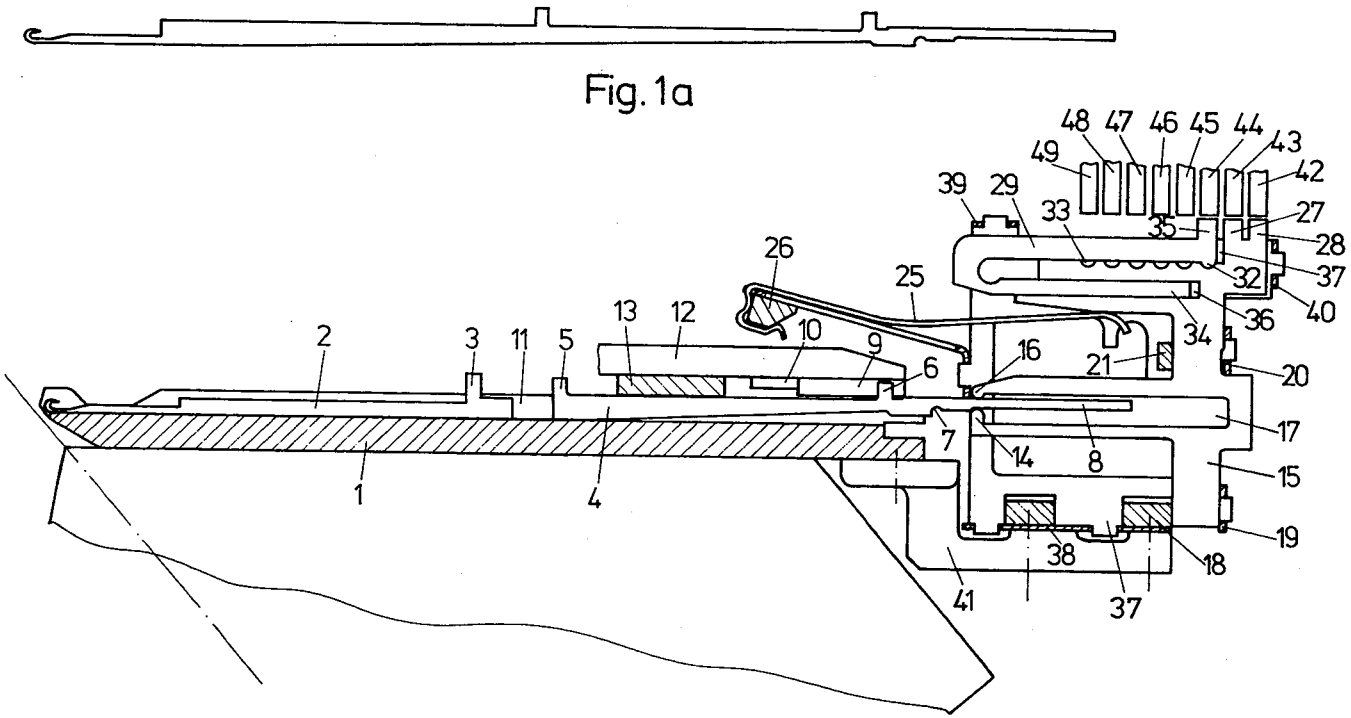

In the knitting machine needle bed 1 illustrated in FIG. 1 provided with control apparatus there is mounted a needle 2. A foot 3 of the needle 2 projects sufficiently far from the needle bed 1 for it to be engageable by a cam illustrated in FIG. 25. In addition to the needle 2, a pattern plate 4 is also mounted in a slot 11 in the needle bed 1. A foot 5 of the pattern plate 4 likewise projects from the needle bed 1. The purpose of this foot 5 is to enable the pattern plate 4 to be moved manually to an inoperative position. A further foot 6 of the pattern plate 4 projects completely from the needle bed 1 and in the illustrated position the foot 6 can be engaged by two parts 9 and 10 of a cam 50 which is attached to a slide 12.

Figures 2, 3:
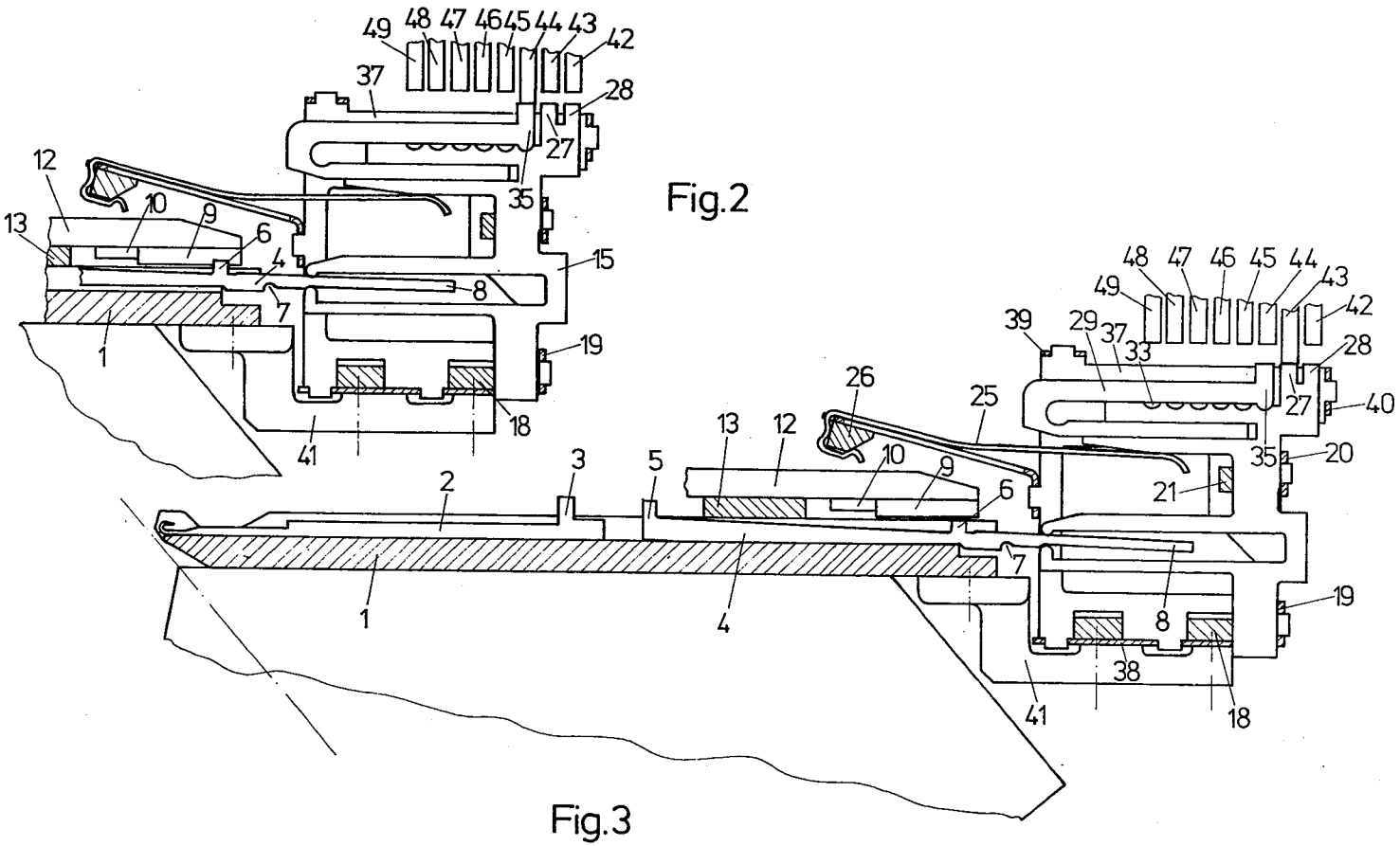
FIG. 2 is a cross-sectional view of part of the needle bed shown in FIG. 1, the pattern plate being pressed so far into the needle bed that its foot projects only partially from the needle bed and the needle is driven out only for forming catch stitches.
FIG. 3 is a cross-sectional view similar to that of FIG. 1 and shows the pattern plate swung in such a position that its foot is not engaged by any part of the cam.

If, as shown in FIG. 2, the pattern plate 4 is swung downwards, the foot 6 on the pattern plate only projects a sufficient distance from the needle bed 1 for it to be engageable by the cam part 9 but not by the cam part 10. If, on the other hand, the pattern plate 4 is swung into a bottom position as illustrated in FIG. 3 then the foot 6 is withdrawn completely into the needle bed 1 and cannot therefore be engaged by either of the cam parts 9 and 10.

To prevent the pattern plate 4 from coming free of the needle bed 1, it is retained by a hold-down member 13. If the needle 1 is to be moved to an inoperative position, the pattern plate 4 is pushed rearwardly in the needle bed 1 (to the right in FIGS. 1 to 3) so that a latching groove 7 formed in the pattern plate 4 engages a lug 14 on an intermediate member 15 to be described in detail hereinafter. In this "latched" position neither the pattern plate 4 nor the needle 2 can be engaged by the cam 50.

Figure 4:
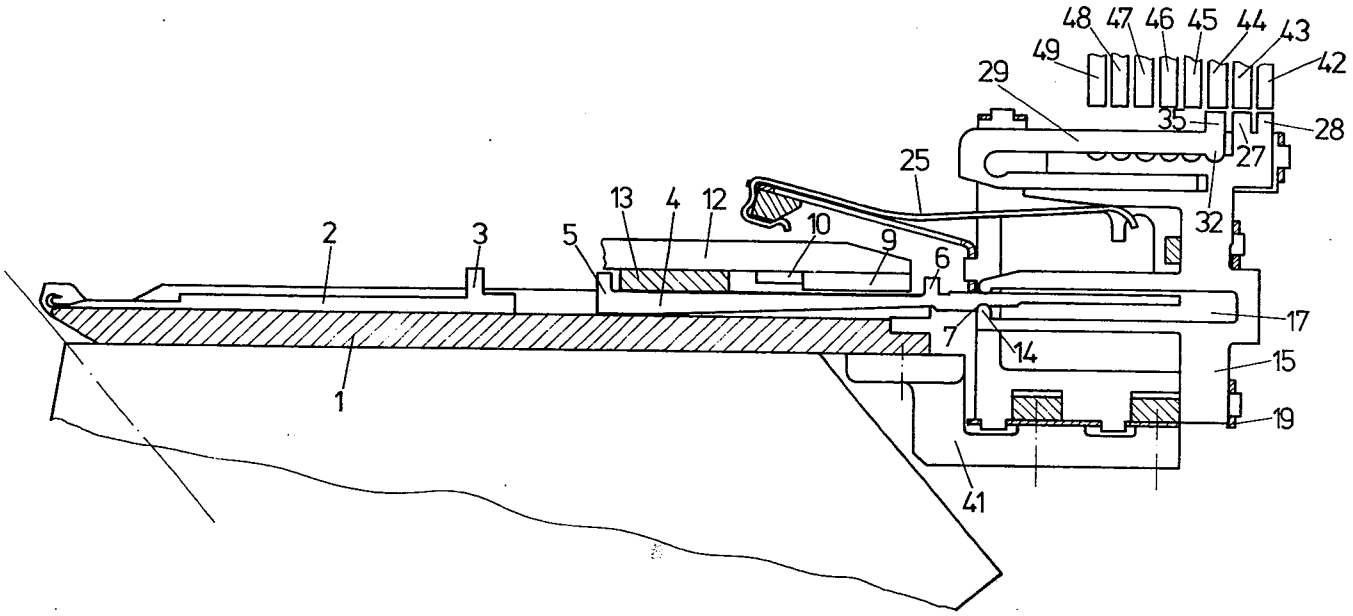
FIG. 4 is a cross-sectional view similar to that of FIG. 1 and shows the withdrawn pattern plate which is latched in the intermediate member.

The above-described swinging of the pattern plate 4 is achieved by means of an upwardly and downwardly movable intermediate member 15. The pattern plate 4 slides with an extension shaft 8 thereof between the lug 14 and a further lug 16 on the intermediate member 15 and is so held above and below that it cannot be knocked away. A recess 17 formed in the intermediate member 15 is of such length that the extension shaft 8 of the pattern plate 4 can be accomodated even in the fully withdrawn position of the pattern plate 4, as illustrated in FIG. 4.

Instead of being separate elements, the needle and pattern plate may, as shown in FIG. 1*a,* be integral.

The intermediate member illustrated in FIGS. 1 to 4 is mounted in parallel guides 18, 19, 20 and 21. Alternatively, the intermediate member 15, as shown in FIG. 13 to 15 and FIG. 17, be mounted in a bearing 22 by means of a guide arrangement incorporating parallel levers 23 and 24. By means of a readily replaceable spring 25 which is fitted on a bar 26 extending along the needle bed 1, the intermediate member 15 can always be brought into an uppermoste position as shown for example, in FIGS. 1, 13 and 17.

The intermediate member 15 may also take the form of a lever which can be swung about a pivot 110 as shown in FIG. 16.

Fixed feet 27 and 28 are provided in different rows on each intermediate member 15, and as the slide 12 moves along, pressure strips 42 and 43 provided on the slide can engage these feet of the intermediate members. The fixed feet 27 and 28 on the various intermediate members 15 differ from each other in that 2 feet 27 and 28 may be provided as in FIG. 8, or only a rear foot 28, as shown in FIG. 9, or only a front foot 27, as shown in FIG. 10, or no foot at all as shown in FIG. 11.

The purpose of the fixed feet 27 and 28 is to control a "basic"position of the needle 2. Thus, for example as shown in FIG. 12, the various intermediate members 15 are so distributed over the needle compartments in successive slots 11 in the needle bed 1 that rear fixed feet 28 are present only in each second slot, and front feet 27 only in each third slot. With such an arrangement, a 1:1 or 2:1 knitted edge can be formed by actuating the pressure strips 42 and 43 without the need for tilting any element in the needle bed 1. It will be understood that if more than two fixed feet 27 and 28 are provided, other combinations of the basic divisions for forming the edge of the knitted piece can be achieved.

In addition to the fixed feet 27 and 28 provided on the intermediate member 15, at least one foot 35, displaceable relatively to the intermediate member 15, is provided, and in all of the arrangements illustrated, this foot can be displaced into a total of six positions below pressure strips 44, 45, 46, 47, 48 and 49 arranged in parallel rows likewise on the slide 12. This results in a large number of possible patterns controlled by the pressure strips and the intermediate member 15 with its displaceable foot 35.

In the embodiment illustrated in FIGS. 1 to 15, the displaceable foot 35 on the intermediate member 15 is the foot of a selector plate 29 which is directly displaceable in the intermediate member 15 and, as shown in the drawing, can be latched in any of six positions. Through a lug 32 the selector plate 29 latches in any one of six notches 33, for example in a first position in FIG. 5, a third position in FIG. 6 and a sixth position in FIG. 7. The selector plate 29 is U-shaped and is guided by a limb 34 in a slot 36 formed in the intermediate member 15. In each position set the foot 35 projects beyond a guide plate 37 so that it can be depressed by one of the pressure strips 44 to 49. The guide plates 37 for the various intermediate members 15 are held together by the strips 38, the parallel guides 19, 20 and 21 and strips 39 and 40, and are secured to the needle bed 1 by a mounting element 41.

It can be clearly seen from FIGS. 13 to 15 that, in the case of intermediate members 15 that are mounted by means of a parallelogram guide arrangement, the feet 27, 28 and 35 are slightly displaced to the side in relation to the pressure strips 42 to 49, when up and down movements of the intermediate members 15 take palce. To offset this displacement, at least as regards the displaceable foot 35, this latter foot, as shown in FIG. 17, may also be provided on a tilting plate 30 instead of on the selector plate 29, which tilting plate is not mounted in the intermediate member itself but in a fixed plate bed 31 disposed above the intermediate member. In this case the intermediate member 15 may also take the form of a lever as illustrated in FIG. 16. However, with a mounting arrangement of this kind, the tilting plate 30 must travel slightly differing distances in the various positions in order to obtain the correct positions on the pattern plates 4.

As already explained, the intermediate member 15 is actuated by the pressure strips 42 to 49 either by way of its fixed feet 27 or 28, or by means of the displaceable foot 35 on the selector plate 29 or the tilting plate 30. Each of these pressure strips is associated with a particular knitting system or with a position for selecting stitch transfer, and is mounted on the slide 12. Each of the pressure strips 42 to 49 can be shifted independently of the other pressure strips into each of three position, i.e. a non-operative or "out" position, a half-way position, and a fully operative or "full" position. For example, of the pressure strips 42 to 49 in FIG. 1, the pressure strip 43*r* in FIG. 19 and the pressure strip 42*r* in FIG. 20 are shown in the non-operative or out position. The pressure strip 44 in FIG. 2 and the pressure strip 44*r* in FIG. 19 are shown, for example, in the half-way position. Finally the pressure strips 43 in FIG. 3 and 43*r* in FIG. 20, and the pressure strips 42*l* and 43*r* in FIG. 18 are shown, for example in their fully operative position. It should be mentioned here that the letters *l* and *r* added to the reference numerals refer respectively to parts arranged on the left-hand or right-hand side of the slide as can be clearly seen from FIGS. 18 and 21.

As shown in FIG. 18, each of the pressure strips 42 to 49 is attached to shift plates 52, 53, e.g. the pressure strip 42*r* is attached to the shift plate 52, and the pressure strip 42*l* to the shift plate 53. the shift plate 52 is mounted on levers 54 and 55, and the shift plate 53 on levers 56 and 57. To retain the shift plates in their basic position, they are each pulled outwards by springs 58 and are thus swung upwards by the levers 54 and 55, and 56 and 57 arranged in pairs in a parallelogram guide system. The shift plates 52 and 53 are guided in guide plates 59 and 60. The shift plates 52 and 53 contact intermediate bearings 61 in their upper positions.

As shown in FIG. 18, the shift plates, which extend in the direction of movement of the slide, have inclined faces 62 whereby they can move out of the needle compartment on a fixed-axis roller 107, and they are pressed by this roller into their fully operative position. At the same time, stop strips 63 to 70, disposed at right angles to the plane of the shift plates 52 and 53, extend up a lifting cam 71, as shown in FIG. 21, and are pressed back to such an extent that stop faces 80 on stops 72 to 79, fitted on the stop strips 63 to 70, lie behind stop pins 81 of control electromagnets 82 to 95. Associated with each shift plate 52 and 53 is one of the stop strips 63 to 70 which will be described hereinafter.

In the position of the shift plates 52 and 53 and stop strips 63 to 70 that is determined by the roller 107 or the lifting cam 71, the next position of the pressure strips 42 to 49 is selected through control equipment of the straight knitting machine, i.e. by switching on control electromagnets 82 to 95. The electromagnets, selected to suit the required pattern, pull upwardly. When the stop strips 63 to 70 leave the lifting cam 71 they are pulled back by a spring 96 and move into their basic position if not blocked by the stop pin 81 of any of the electromagnets 82 to 95 associated therewith, since all the electromagnets are switched on. If, however, selected electromagnets are not switched on, stop faces 80 on each of the stop strips 63 to 70 lie against the associated stop pins 81. In this position, further strips 97 to 104 on the stop strips 63 to 70, which are provided for stop lugs 105 on the shift plates 52 and 53, lie in front of these stop lugs 105, as shown in FIG. 22, so that the associated pressure strips 42 to 49 move into their inoperative position. This operation always takes place when the particular electromagnets 82 to 95 are not switched on, e.g. the electromagnet 83 in the case of the stop strip 64, the magnet 84 and 85 in the case of the stop strip 65, and so on.

If for example the electromagnet **82*r* is now switched on, its stop pin 81 releases the stop 72 of the bottom stop strip 63*r* in FIG. 22, so that the stop strip 63*r* is pulled by the spring 96 so far downwards in FIG. 1 or so far to the right in FIG. 2 that the stop 97*r* lies above the stop lug 105 of the shift plate 52, as is also shown in FIGS. 23 and 24. In this position the stop 97*r* prevents the shift plate 52 on the slide 12 from moving upwards. The associated pressure strip 42*r* is thus located in its fully operative position, i.e. it is fully engaged. Upon the next movement of the slide, the pressure strip 42*r* presses all those intermediate members 15 that have one foot 28 downwards into a position in which the intermediate member 15 swings the pattern plate 4 so far that the foot 6 on the pattern plate 4 is withdrawn into the needle bed 1. Thus, when the intermediate members 15 are arranged as in the system shown in FIG. 12 and only the electromagnets 82*r* and 82*l* are switched in, the straight knitting machine produces a 1:1 stitch. If, on the other hand, only the electromagnets 83*r* and 83*l*** are switched on, the knitting machine produces a 2:1 stitch.

The stops 99 to 104 on the stop strips 65 to 70 that come into contact with the stop lugs 105 of the shift plates 52 and 53 each have a shoulder 106. Furthermore, not just one but two spaced control electromagnets, e.g. the electromagnets **86*r* and 87*r* for the stop strip 65*r*, are provided for these stop strips 65 to 70. If, for example, the electromagnet 87*r* is now switched on but the electromagnet 86*r* is not, the stop face 80 on the stop 74 bears against the stop pin 81 of the electromagnet 86*r*. The stop strip 65*r* is then moved so far forward by its ring 96 that the associated stop 99*r* lies by its shoulder 106 above the stop lug 105 of the associated shift plate. The associated shift plate is thus held in a half-way position, and, as shown in FIG. 18, the pressure strip 44 is also therefore retained in the half-way position. As shown in FIG. 23 the stop 99 engages the associated shift plate in this way, whereas in FIG. 24 the stop 99** holds the associated shift plate in the fully operative position.

All of the intermediate members 15, for which the pattern plates 29 are immobilized in the first position shown in FIG. 5, are pressed downwards by the pressure strip 44 that has moved into the half-way position, and these intermediate members swing the associated pattern plate 4 so far that the foot 6 of the pattern plate can only be engaged by part 9 of the cam. The associated needle 2 then forms a loop over the right-hand part of the cam.

If in addition, the electromagnets **94*r* and 95*r* for example are switched on the stop 79 on the stop strip 70*r* is moved forward by its spring 96 to such an extent that a lug 108 below the shoulder 106 of the stop 104*r* lies above the stop lug 105 on the associated shift plate, as illustrated in FIG. 24 in the case of a lug 104. The shift plate and, at the same time, the associated pressure strip 49*r* are confined to the fully operative position. The pressure strip 49*r* depresses all those pattern plates 29 which are in the sixth position as shown in FIG. 11, and therefore depresses the intermediate member 15 to such an extent that the pattern plate 4 executes a swinging movement in which its foot is withdrawn into the needle bed 1. All of the needles 2 associated with these intermediate members 15** therefore do not operate over the right-hand portion of the cam during this movement of the slide.

If neither of the two electromagnets **88*r* and 89*r* is switched on, the face 80 of the stop 76 on the stop strip 87*r* engages the stop pin 81 of the electromagnet 89*r*, and during the next travel of the slide, the stop strip 67*r* remains in its fully pressured position. The stop lug 105 of the associated shift plates can therefore move past the stop 101*r*, and the pressure strip 46*r* moves into the non-operative position. None of the pattern plates 29, located in the third position as illustrated for example in FIG. 6, is pressed, and the associated intermediate member 15 remains in the basic position and the corresponding foot 6 of the associated pattern plate 4 projects so far from the needle bed 1 that it is engaged both by part 9 and part 10 of the cam. In this case all of the associated needles 2** form switches over the right-hand portion of the cam.

Finally, FIG. 25 shows a plan view of a cam 50 in which the shape of the parts of the parts 9 and 10 for pushing out the pattern plates 4 can be seen. The feet 6 of the pattern plate 4 move in a channel 51 in the cam.

Having now particularly described the invention, it is to be understood that various changes and modifications may be made within the scope of the following claims.

I claim:

1. A straight knitting machine comprising: a needle bed, needle means carried by said needle bed, a slide, cam means carried by said slide for selectively actuating said needle means for carrying out casting-on, loop-forming and stitch transfer, by lowering or lifing the needle means into or out of the needle bed so that a foot of each needle means completely or partially projects from the needle bed or is withdrawn completely into the needle bed, spring means for raising said needle means, rows of pressure strips for pressing the needle means into the needle bed, said pressure strips being mounted for staggered displacement on said slide which carries said cam means, a selector element selectively adjustable in several stages with respect to each row of said pressure strips and being operatively associated with each slot in the needle bed for transmitting control movements from the pressure strips to each needle means, intermediate members, each needle means comprising a shaft, the shaft of said needle means being mounted in a respective intermediate member without clearance above and blow, at least some of said intermediate members having feet arranged in a plurality of rows for engagement by one or more of said pressure strips said feet being immovably arranged on at least some of said intermediate members, and at least on movable foot being provided on each intermediate member for movement selectively into different row, the position at which the intermediate members in a needle compartment of the knitting machine are inserted being non-alterable, said cam means having no displaceable lifting parts for moving the needle means.

2. A straight knitting machine as claimed in claim 1, in which the needle means each comprise a needle and an element for controlling the needle.

3. A straight knitting machine as claimed in claim 1, in which the shaft of each needle means has a notch whereby the needle means can be latched into its intermediate member when in a non-operative position.

4. A straight knitting machine as claimed in claim 1, in which the pressure strips which press on to the feet of the intermediate member are mounted in the slide in a parallelogram guide, and depth of displacement of the pressure strips is limited by displaceable stop strips.

5. A straight knitting machine as claimed in claim 1 in which the displaceable foot of the intermediate member is the foot of a selector plate which is displaceably mounted relatively to the intermediate member.

6. A straight knitting machine as claimed in claim 5 in which the displaceable selector plate is mounted directly in the intermediate member and is immobilized in each of its set positions by notches formed in the intermediate member.

7. A straight knitting machine as claimed in claim 5, in which the displaceable selector plate is a tilting plate which is mounted in a separate plate bed extending over the entire width of the needle compartment and which is immobilized in each of its set positions in notches which are formed in a bar of the machine bed and extend over the entire width of the needle compartment.

8. A straight knitting machine as claimed in claim 1 in which the intermediate member is mounted in parallel guides.

9. A straight knitting machine as claimed in claim 1 in which the intermediate member is mounted by means of a parallelogram guide arrangement.

10. A straight knitting machine as claimed in claim 1 in which the intermediate member comprises a suitable lever.

11. A straight knitting machine as claimed in claim 1 further comprising a shift plate associated with each pressure strip, each shift plate having a stop lug, and said machine further comprising a stop which engages the stop lug to retain the shift plate in a selected position.

12. A straight knitting machine as claimed in claim 11 in which each shift plate is associated with a stop strip on which is fitted a stop for retaining the shift plate.

13. A straight knitting machine as claimed in claim 11, in which at least some of the stops for retaining the shift plates have a shoulder.

14. A straight knitting machine as claimed in claim 12, including a further stop associated with each stop strip which further stop is engageable with a stop pin controlled by an associated electromagnet.

15. A straight knitting machine as claimed in claim 14 in which at least one electromagnet with spaced stop pins is associated with each stop strip.

16. A straight knitting machine as claimed in claim 11 in which the shift plates for the pressure strips in the various rows are arranged parallel to each other and side-by-side, and the associated stop strips are arranged in superimposed relationship on the slide in a plane at right angles to the planes of the shift plates.

* * * * *